US012686985B2

(12) United States Patent
Beck et al.

(10) Patent No.: US 12,686,985 B2
(45) Date of Patent: Jul. 21, 2026

(54) METHODS AND APPARATUS FOR BUILDING EXPANDED SHAFT AUGURED FOUNDATION ELEMENTS

(71) Applicant: GEOPIER FOUNDATION COMPANY, INC., Davidson, NC (US)

(72) Inventors: August Beck, Davidson, NC (US); Kord J. Wissmann, Davidson, NC (US)

(73) Assignee: Geopier Foundation Company, Inc., Davidson, NC (US)

( * ) Notice: Subject to any disclaimer, the term of this patent is extended or adjusted under 35 U.S.C. 154(b) by 43 days.

(21) Appl. No.: 18/728,740

(22) PCT Filed: Jan. 13, 2023

(86) PCT No.: PCT/US2023/010798
§ 371 (c)(1),
(2) Date: Jul. 12, 2024

(87) PCT Pub. No.: WO2023/137176
PCT Pub. Date: Jul. 20, 2023

(65) Prior Publication Data

US 2025/0109564 A1 Apr. 3, 2025

Related U.S. Application Data

(60) Provisional application No. 63/299,179, filed on Jan. 13, 2022.

(51) Int. Cl.
*E02D 5/36* (2006.01)

(52) U.S. Cl.
CPC ..... *E02D 5/36* (2013.01); *E02D 2250/003* (2013.01); *E02D 2250/0038* (2013.01)

(58) Field of Classification Search
CPC ..... E02D 5/36; E02D 2250/003; E02D 2250/0038; E02D 2200/1671
See application file for complete search history.

(56) References Cited

U.S. PATENT DOCUMENTS

| | | | | |
|---|---|---|---|---|
| 3,240,513 | A | 3/1966 | Turzillo | |
| 5,013,191 | A | 5/1991 | Kitanaka | |
| 7,357,199 | B2 | 4/2008 | Pedrelli | |
| 8,926,228 | B2 * | 1/2015 | Stroyer | E02D 5/52 175/323 |
| 9,068,409 | B2 | 6/2015 | Mohamed | |
| 2010/0263928 | A1 * | 10/2010 | Massari | E02D 7/22 175/19 |

FOREIGN PATENT DOCUMENTS

| | | |
|---|---|---|
| EP | 2246478 A1 | 11/2010 |
| JP | 3145827 U | 10/2008 |
| WO | 0042256 A1 | 7/2000 |

OTHER PUBLICATIONS

International Search Report and Written Opinion issued in counterpart PCT Application No. PCT/US2023/010798 dated Apr. 13, 2023 (seventeen (17) pages).

* cited by examiner

*Primary Examiner* — Kyle Armstrong
(74) *Attorney, Agent, or Firm* — E. Eric Mills; Todd A. Serbin; Maynard Nexsen PC

(57) ABSTRACT

An apparatus for building expanded shaft augured foundation elements, comprising: a dual-section drilling augur having a lower section and an upper section, wherein the lower section and the upper section are configured to rotate relative to each other.

19 Claims, 10 Drawing Sheets

METHODS AND APPARATUS FOR BUILDING EXPANDED SHAFT AUGURED FOUNDATION ELEMENTS

CROSS REFERENCE TO RELATED APPLICATIONS

This application is a 35 U.S.C. § 371 U.S. national phase entry of International Patent Application No. PCT/US2023/010798 having an international filing date of Jan. 13, 2023, which claims the benefit of priority under Article 8 PCT of U.S. Provisional Patent Application No. 63/299,179 filed Jan. 13, 2022, the contents of which are incorporated herein by reference in their entirety.

FIELD OF THE INVENTION

The invention disclosed herein relates generally to the efficient construction of Rigid Cementitious Inclusions used to support structures such as buildings, foundations, floor slabs, walls, embankments, pavements and other improvements.

BACKGROUND OF THE INVENTION

Heavy or settlement sensitive facilities that are located in areas containing soft, loose, or weak soils are often supported on deep foundations. Such deep foundations are typically made from driven pilings or concrete piers installed using drilling methods. The deep foundations are designed to transfer structural loads through the soft soils to more competent soil strata. Deep foundations are often relatively expensive because of the relatively high cost of reinforcing steel required to tie the deep foundations to the supported structures and because deep foundation often extend to great depths to achieve required capacity.

Another way to support such structures is to excavate out the soft, loose, or weak soils and then fill the excavation with more competent material. The entire area under the building foundation is normally excavated and replaced to the depth of the soft, loose, or weak soil. This method is advantageous because it is performed with conventional earthwork methods but has the disadvantages of being costly when performed in urban areas and that may require that costly dewatering or shoring be performed to stabilize the excavation.

In the past 25 years, ground improvement methods such as aggregate columns have been increasingly used to support structures located in areas containing soft soils. These columns are generally considered to be "ground improvement" because the columns are designed to reinforce and strengthen the soft layer and minimize resulting settlements. The columns are constructed using a variety of methods including the drilling and tamping method described in U.S. Pat. Nos. 5,249,892 and 6,354,766; the driven mandrel method described in U.S. Pat. No. 6,425,713; the tamper head driven mandrel method described in U.S. Pat. No. 7,226,246; and the driven tapered mandrel method described in U.S. Pat. No. 7,326,004; the disclosures of which are incorporated by reference in their entirety. Ground improvement methods are increasingly considered to be preferential to deep foundations and excavation/replacement because these methods often result in project cost and schedule savings.

More recently ground improvement methods generally referred to as "rigid inclusions" have been developed and used for foundation support. Augured cast-in-place piles utilize an augur that removes the soil by upward conveyance and backfills the cavity with a sand-cement grout mixture. "Controlled Modulus Columns" consist of a method developed originally in France and consist of penetrating the subsurface soil with a displacement augur and inserting sand-cement grout materials into the ground during augur retrieval. A similar method called the "DeWaal" pile is similar to the Controlled Modulus Column method except that it utilizes a displacement augur of a different geometric design. Drilled Rigid Inclusions are advantageous for construction because they do not depend on the confinement offered by soft soil layers for capacity, because they are not structurally connected to the supported structure and thus exhibit cost savings associated with not including reinforcing steel within the elements, and because they are an efficient construction method in materials that are conducive to auguring. However, these methods have the disadvantage that they are constructed with uniform element diameters and are thus limited in their geotechnical capacity development. What is needed in the field is a Rigid Inclusion method that provides greater geotechnical capacity at shallower depths.

Another Rigid Inclusion construction method known as the "Grouted Impact Pier" method was developed by Fox, Wissmann and their co-inventors and consists of displacement subsurface materials with displacement mandrels that include compaction heads to densify and laterally displace the placed aggregate, cement, and water mixtures. An improvement upon this method is called the "Geo-Concrete Column" method that provides for construction with driven displacement mandrels, pressurized injection of concrete, and compaction of the concrete to form expanded bottom bulbs in the penetrated soil. Both the Grouted Impact Pier method and the GeoConcrete Column method have the advantage over other forms of Rigid Inclusions because they allow the constructor to vary the pier diameter and thus the geotechnical capacity by changing the compaction stroke pattern. These methods are particularly useful in soil conditions that are conducive to displacement driving but may be limited for applications in which surrounding structures are vibration sensitive or where the penetrated soils are not conducive to driven displacement techniques.

SUMMARY OF THE INVENTION

According to an aspect of some embodiments of the present invention there is provided an apparatus for building expanded shaft augured foundation elements, comprising a dual-section drilling augur having a lower section and an upper section, wherein the lower section and the upper section are configured to rotate relative to each other.

In an embodiment of the invention, the apparatus further comprises an augur conveyance restriction element disposed between the lower section and the upper section.

In an embodiment of the invention, the upper section rotates independently from the lower section.

In an embodiment of the invention, the upper section terminates in a flat, horizontal flange at a lower end of the upper section.

In an embodiment of the invention, the flange is a half-circle in profile when viewed from the bottom of the flange.

In an embodiment of the invention, the diameter of the flange is the same or less than the diameter of at least one flight of the augur.

In an embodiment of the invention, the lower section terminates in a flat, horizontal flange at an upper end of the lower section.

In an embodiment of the invention, the flange is a half-circle in profile when viewed from the bottom of the flange.

In an embodiment of the invention, the diameter of the flange is the same or less than the diameter of at least one flight of the augur.

In an embodiment of the invention, a lower portion of the upper section and an upper portion of the lower section form the augur conveyance restrictor element.

In an embodiment of the invention, the augur conveyance restrictor element is configured in an open configuration when the upper section is aligned coincident with the lower section.

In an embodiment of the invention, augur conveyance restrictor element is configured in a closed configuration when the upper section is not aligned coincident with the lower section.

In an embodiment of the invention, the apparatus further comprises a hollow augur stem through which backfill material flows during operation.

In an embodiment of the invention, the apparatus further comprises a tip at a bottom end of the dual-section drilling augur through which backfill material flows during operation.

According to an aspect of some embodiments of the present invention there is further provided method for building expanded shaft augured foundation elements, comprising: aligning a lower section and an upper section of a dual-section drilling augur to achieve an open configuration to allow for augur spoil conveyance; advancing the dual-section drilling augur in to a subsurface ground material, wherein as the dual-section drilling augur cuts into the subsurface material, cuttings are conveyed upwards on flights of the dual-section drilling augur, enabled by the open configuration; placing backfill material into the dual-section drilling augur when design depth has been achieved; raising the dual-section drilling augur to allow the flow of the backfill material out of the dual-section drilling augur at the design depth; re-advancing the dual-section drilling augur downwardly into the backfill material until the backfill material forms cuttings on augur flights of the lower section; reversing rotation direction of the dual-section drilling augur causing the upper section to swivel relative to the lower section and placing the dual-section drilling augur into a closed configuration which prohibits the upward conveyance of cuttings; and, creating an expanded shaft, augured foundation element through a combination of downwardly movement and the reverse rotation of the dual-section drilling augur forcing the backfill material cuttings that are on the augur flights of the lower section to move down and outward relative to the dual-section drilling augur.

In an embodiment of the invention, reversing rotation is rotating the dual-section drilling augur in a counter-clockwise direction.

In an embodiment of the invention, backfill material is placed into a hollow augur stem of the dual-section drilling augur.

In an embodiment of the invention, the backfill material flows out of the placing backfill material into the dual-section drilling augur from a tip at a bottom end of the dual-section drilling augur.

In an embodiment of the invention, the expanded shaft is located at at least one of the bottom of the augured foundation element and at a distance above the bottom of the augured foundation element.

In an embodiment of the invention, the method further comprises continuing reverse rotation upwardly to extract the dual-section drilling augur to complete forming the augured foundation element.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example, are not necessarily to scale and are for purposes of illustrative discussion of embodiments of the invention. In this regard, the description taken with the drawings makes apparent to those skilled in the art how embodiments of the invention may be practiced.

In the drawings.

DETAILED DESCRIPTION OF THE INVENTION

Figure 1:
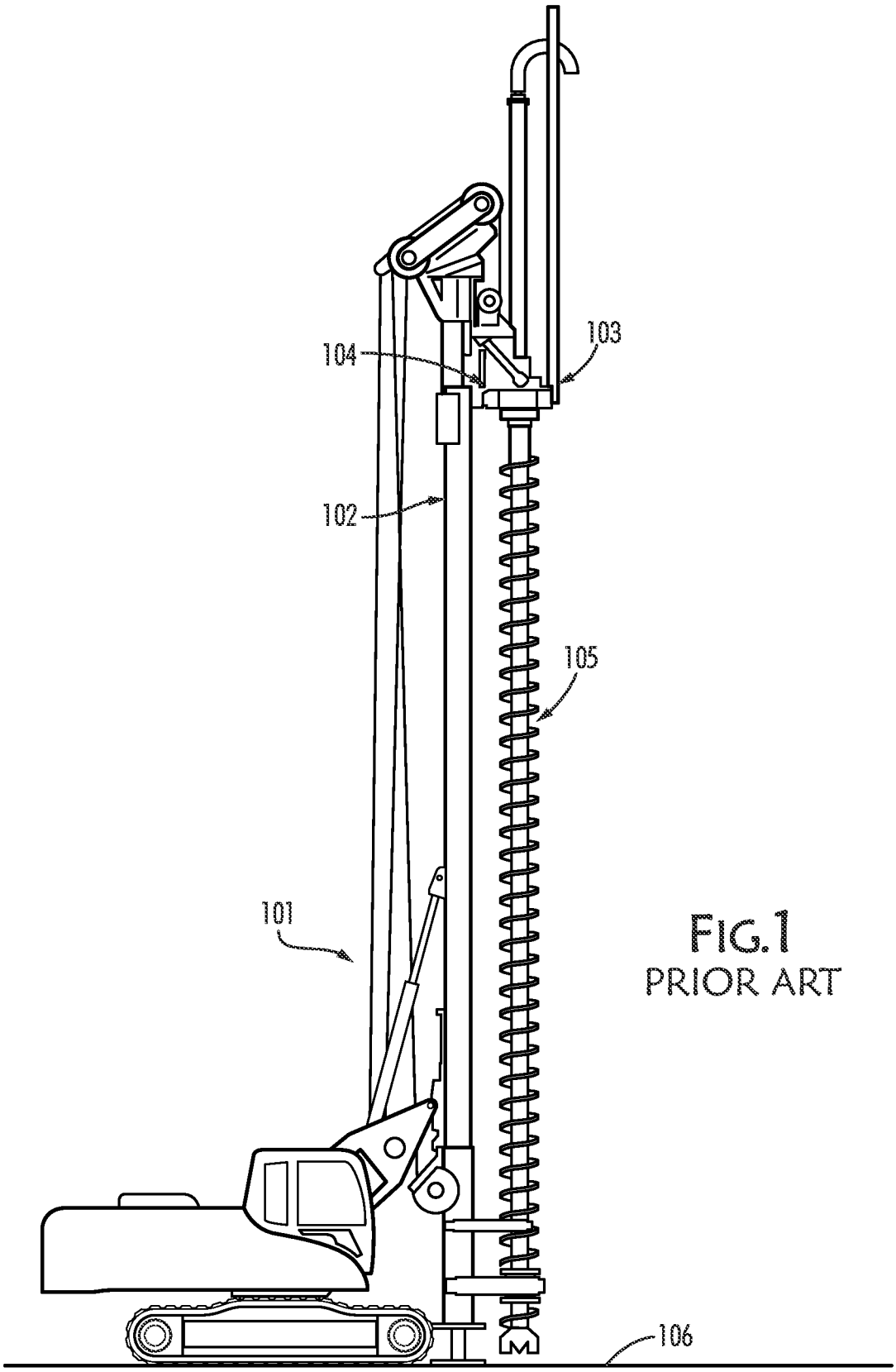
FIG.1 PRIOR ART
FIG. 1 shows a schematic of the typical machine and tooling used to construct augured pilings and rigid inclusions (prior art)

In some embodiments of the invention, an apparatus and method are provided for efficiently constructing drilled rigid inclusions with expanded bottom bulbs that enhance the geotechnical capacity of the constructed elements.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

The invention provides a method and apparatus that may be used to efficiently construct Expanded Shaft Augured Foundation Elements that exhibit a higher soil bearing capacity than those with no bottom expansion. The invention provides a mechanism to produce expanded shaft elements using a unique auger conveyance restriction element that optionally allows or restricts the upward movement of soil cuttings during drilling operations.

The invention provides methods and apparatus that is efficiently used for projects that may have nearby structures that are vibration sensitive and for subsurface materials that may be difficult to penetrate using driven displacement techniques. The invention allows for the constructed of both cementitious and non-cementitious piers where the pier shaft may be expanded to a larger diameter than the penetrating auger. These expanded sections may be constructed at the pier bottom or at locations above the pier bottom, depending on project requirements and subsurface profiles. The invention provides for increased geotechnical capacity of the installed piers as a result of the laterally expanded sections.

The apparatus of the invention consists of a dual-section drilling auger whereby the lower and upper sections of the auger may be rotated relative to each other to alternatively allow for augur spoil conveyance or to restrict augur spoil conveyance. During initial downward auguring operations the augur sections are aligned with each other in the "open" position to allow for augur spoil conveyance. During shaft expansion operations, the augur sections are re-aligned to the "closed" position to restrict augur spoil conveyance. The method of construction allows for changing the augur drilling direction to both open and close the conveyance restrictor element and to expand the shaft diameter of the backfilled materials to create an expanded shaft element.

Figure 2:
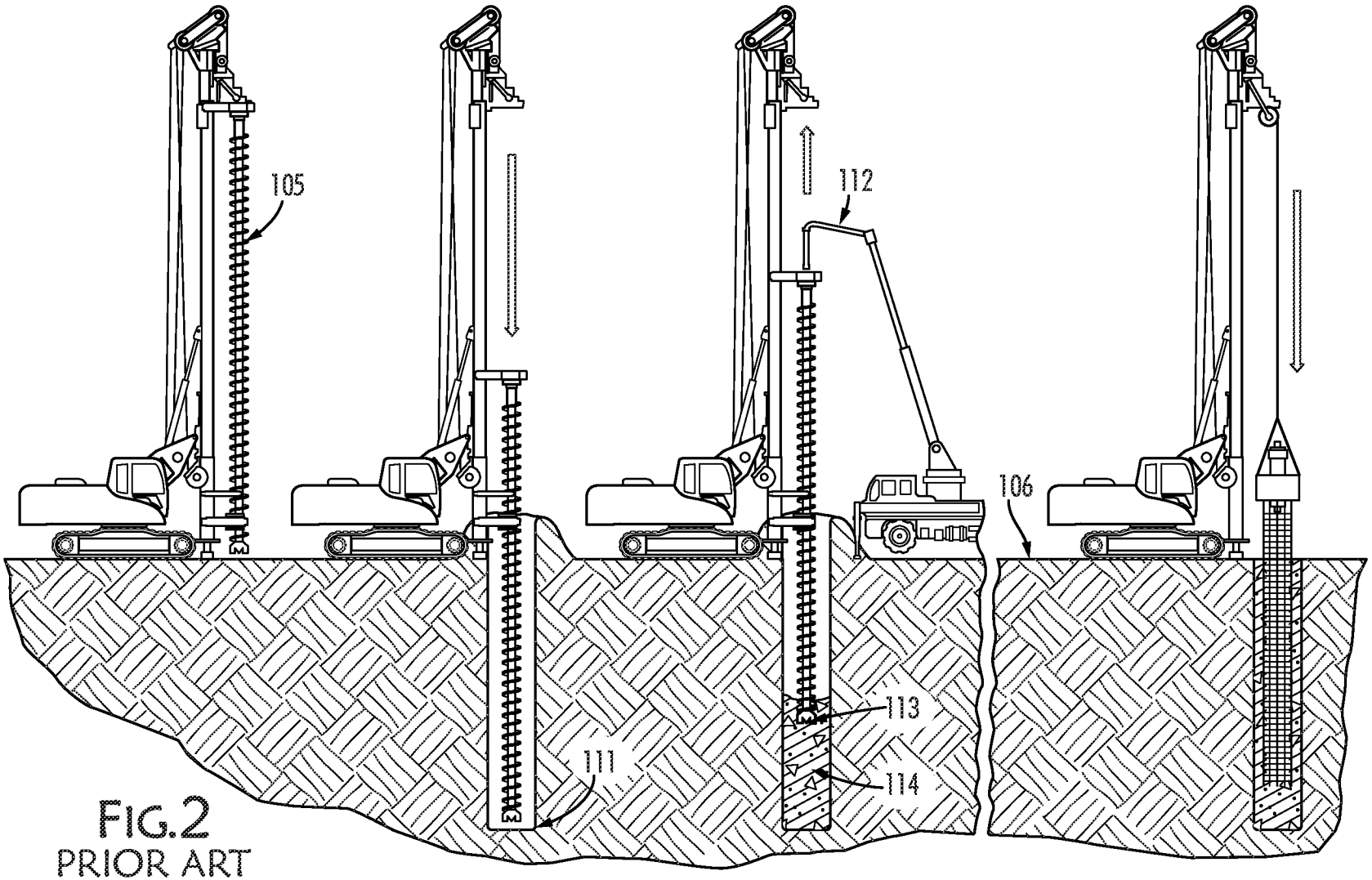
FIG. 2 PRIOR ART
FIG. 2 shows a schematic of the typical construction sequence used to construct an augured cast-in-situ piling or rigid inclusion (prior art)

For purposes of better understanding some embodiments of the present invention, as illustrated in FIGS. 4-10 of the drawings, reference is first made to the construction and operation of a drilling machine as illustrated in FIGS. 1-3.

FIG. 1 shows a schematic of a drilling machine and tooling typically used for the construction of augured cast-in-situ pilings or rigid inclusions (prior art). Construction is typically facilitated with a track-mounted excavator, piling base machine, or crane (101) that is used to support a mast or crane leads (102). A drilling motor (103) is located along the mast or leads (102) and connected to the leads with a "sled" (104) that tracks along the leads/mast (102) in the vertical direction. The drilling motor (103) is connected to an augur (105) that is used to penetrate into the ground (106).

FIG. 2 shows a schematic of the typical construction sequence used to construct an augured cast-in-situ piling or rigid inclusion (prior art). Construction proceeds by drilling the augur (105) into the ground (106) to the required installation depth (111). Once the auger (105) is advanced to the required installation depth (111). Backfill material, often consisting of a cementitious grout mixture (112), is then is pumped through the augur (105) and allowed to flow out of the bottom of the augur (113). The augur (105) is then withdrawn from the foundation soils as grout is pumped and allowed to fill the cavity (114) created by augur withdrawal. The grout mixture (112) often is comprised of various amounts of cement, water, sand, other aggregate, and admixtures.

Figure 3A:
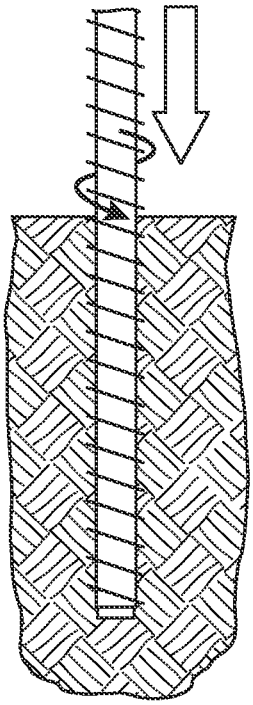
FIG.3A PRIOR ART
FIGS. 3A-3B show various augers that are currently used for construction of pilings and rigid inclusions (prior art)
Figure 3B:
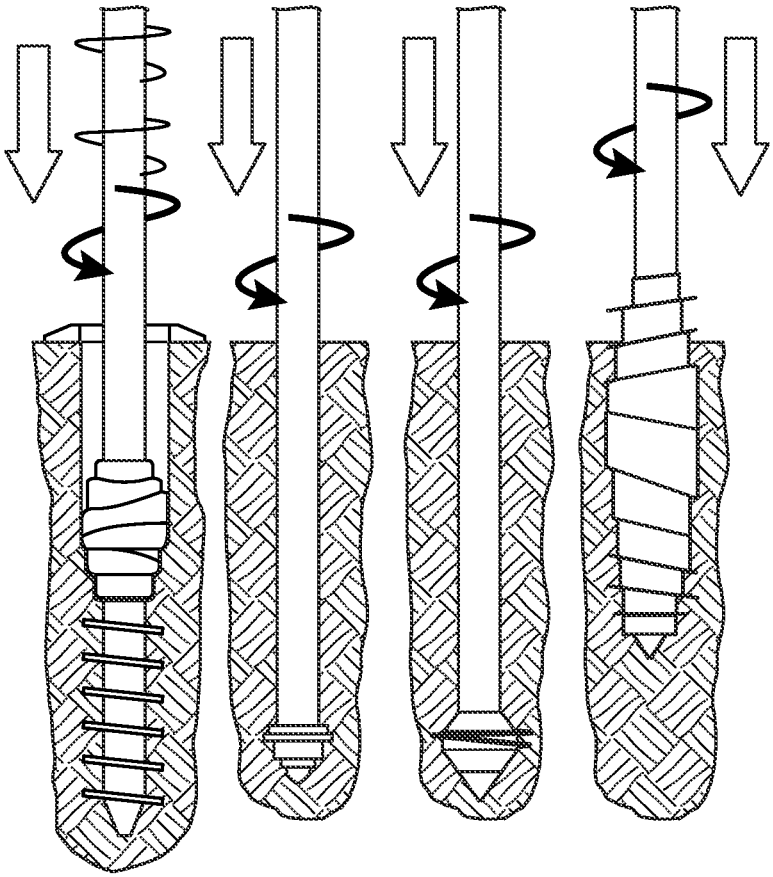
FIG.3B PRIOR ART

FIGS. 3A-3B show various augers that are used in conjunction with the construction process and sequences shown in FIG. 1 and FIG. 2. The different geometries shown in FIGS. 3A-3B are each intended to produce different amounts of displacement vs. replacement of the in-situ soils during auger drilling and extraction. The tool geometry shown in FIG. 3A removes the soil cuttings from the inclusion during drilling and extraction thereby providing for a replacement process. The tool geometries shown in FIG. 3B displace the soil cuttings laterally during drilling and provide for a full-displacement or semi-displacement processes. These tools require the use a base machine (101) and drilling motor (103) that provides for a much higher torque than drills used for displacement processes (105).

Figure 4:
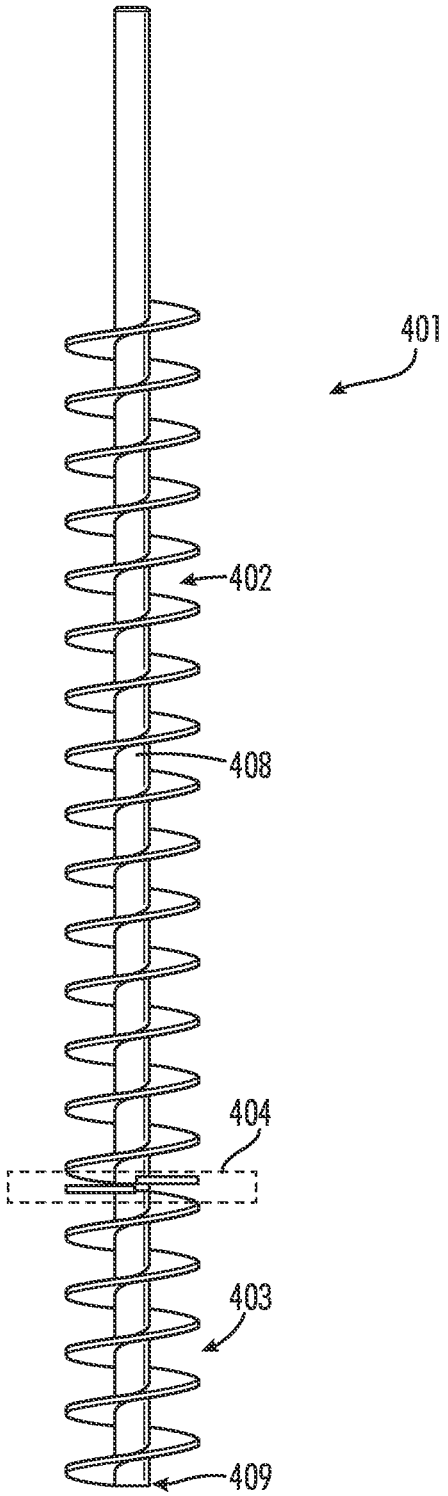
FIG. 4 shows a drawing of a two-section augur with an augur conveyance restriction element of the present invention.

The apparatus shown in FIG. 4 depicts one embodiment of the current invention wherein the apparatus is comprised of a two-section drilling tool (401) with an augur conveyance restriction element (404). In one embodiment, the invention is comprised of an upper section (402), a lower section (403) and an intermediate vertical augur conveyance restriction element (404) that provides for relative rotation of the lower section (403) in comparison to the upper section (402). During the penetration and extraction of the apparatus (401) the upper section (402) may rotate independently from the lower section (403) whereby rotation is facilitated by the intermediate augur conveyance restriction element (404).

Figure 5A:
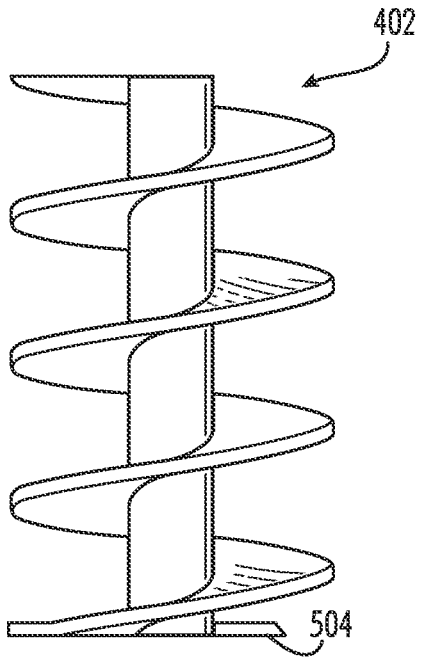
FIGS. 5A-5C show different views of an upper section of the two-section auger of the present invention.
Figure 5C:
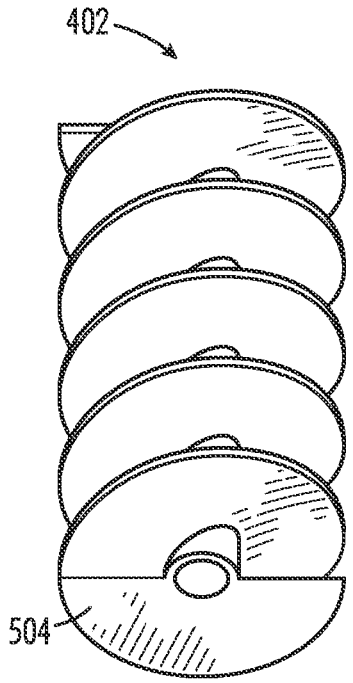
Figure 5B:
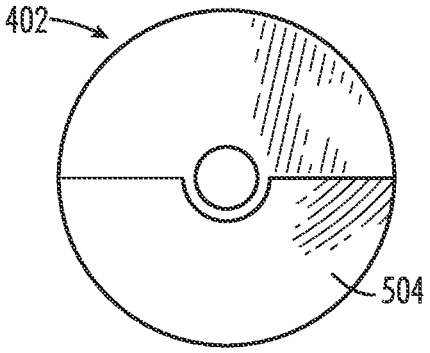

FIGS. 5A-5C show views of the upper portion of the invention shown in FIG. 4. FIG. 5A shows a close-up side view of the upper section (402) of the augur of the current invention. FIG. 5B shows a close-up end view of the upper section (402). FIG. 5C shows a three-dimensional view of the bottom end of the upper section (402). The upper section (402) of the invention consists of a conventional replacement auger that terminates in a flat horizontal flange (504) at its lower end. In one embodiment, the flange is oriented horizontally (FIG. 5A) and comprised of a half-circle when viewed from the bottom as shown in FIG. 5B. The diameter of the flange (504) is the same or less than the diameter of the augur flights as shown in FIG. 5C.

Figure 6A:
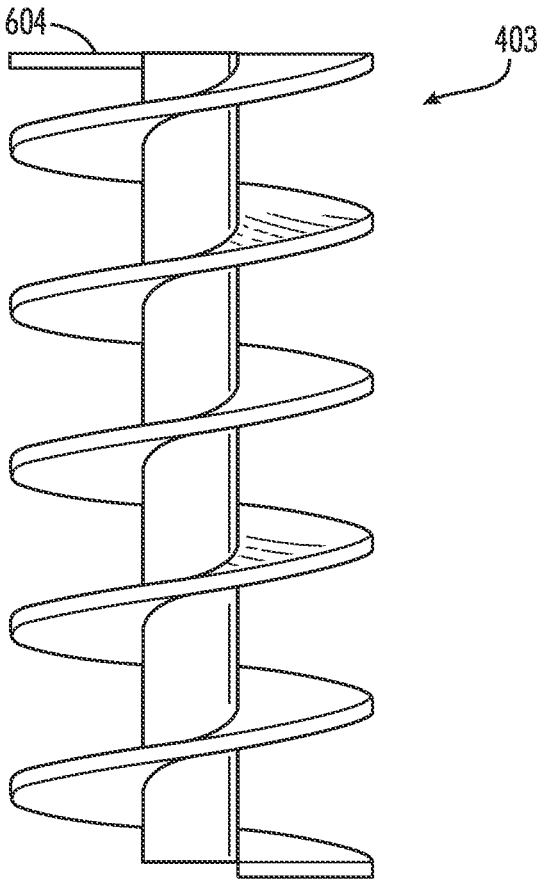
FIGS. 6A-6C show different views of the lower section of the two-section auger of the present invention.
Figure 6C:
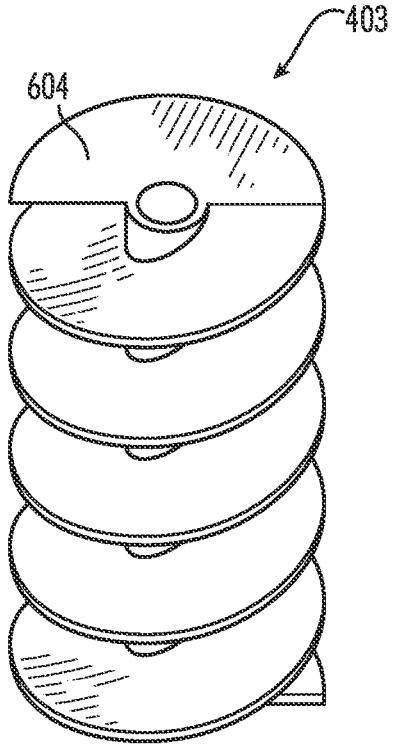
Figure 6B:
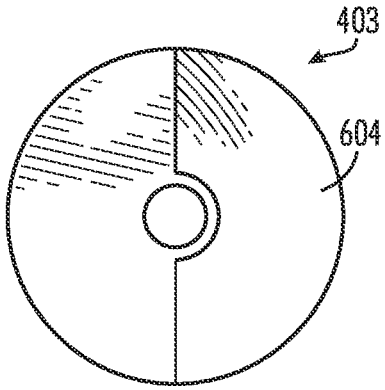

FIGS. 6A-6C show views of the lower portion of the invention shown in FIG. 4. FIG. 6A shows a close-up side view of the lower section (403) of the augur of the current invention. FIG. 6B shows a close-up end view of the lower section (403). FIG. 6C shows a three-dimensional view of the upper end of the lower section (403). The lower section (403) of the invention also consists of a conventional replacement auger that terminates in a flat horizontal flange (604) at its upper end. In one embodiment, the flange is oriented horizontally (FIG. 6A) and comprised of a half-circle when viewed from the bottom as shown in FIG. 6B. The diameter of the flange (604) is the same or less than the diameter of the augur flights as shown in FIG. 6C.

When placed together, the lower portion of the upper section (402) and the upper portion of the lower section (403) form an augur conveyance restrictor element created from the relative positions of the semi-circular flanges (504 and 604).

Figure 7A:
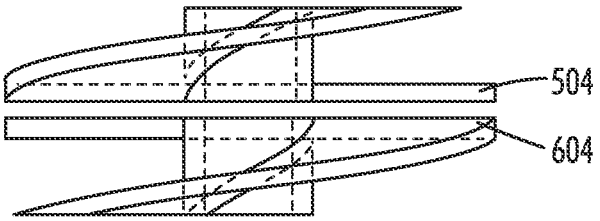
FIGS. 7A-7D shows a drawing of the present invention showing a close-up view with the conveyance restrictor element in the (7A, 7B) open position, and (7C, 7D) closed position.
Figure 7B:
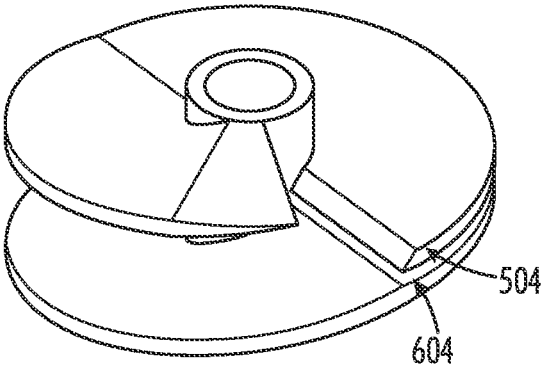
Figure 7C:
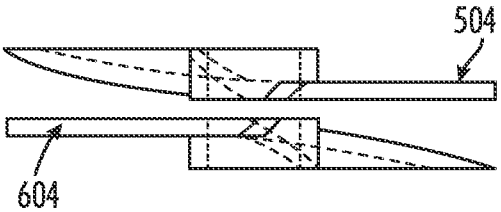
Figure 7D:
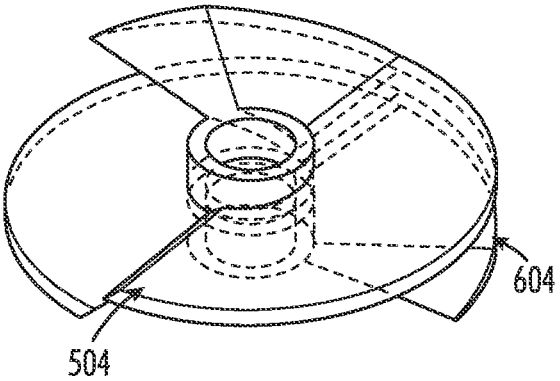

FIGS. 7A-7D show close-up views of the augur conveyance restrictor element of the present invention. FIGS. 7A and 7B show the restrictor element in the "open" position created when the upper section flange (504) is aligned coincident with the lower section flange (604). FIGS. 7C and 7D shows the restrictor element in the "closed" position when the upper section flange (504) is not aligned with the lower section flange (604).

Figure 8A:
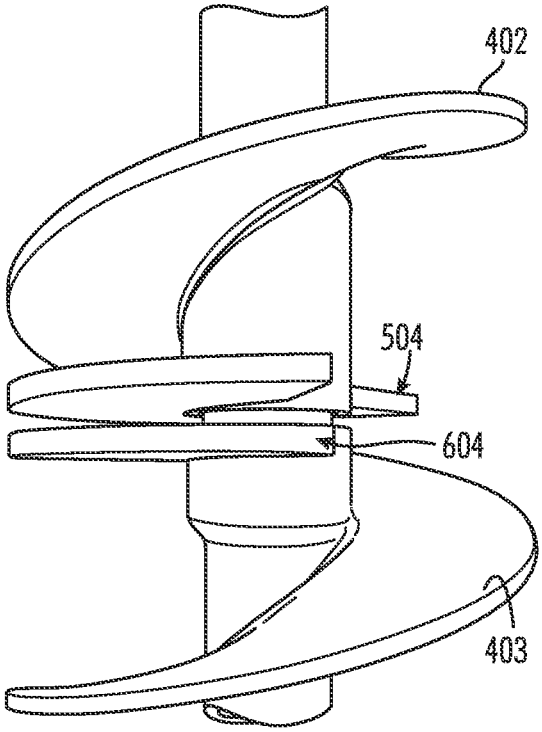
FIGS. 8A and 8B shows images of the invention whereby the conveyance restrictor element is in the (8A) Open position and (8B) Closed position.
Figure 8B:
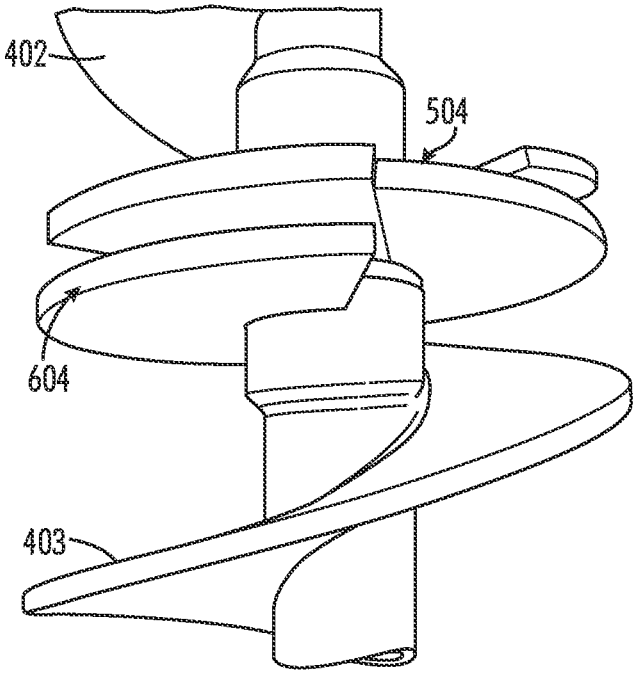

The orientations of the augur conveyance restrictor element shown in FIGS. 7A-7D are shown again in the images shown in FIGS. 8A and 8B. FIG. 8A shows the restrictor element in the "open" position created when the upper section flange (504) is aligned coincident with the lower section flange (604). FIG. 8B shows the restrictor element in the "closed" position when the upper section flange (504) is not aligned with the lower section flange (604).

The apparatus shown in FIG. 4, FIGS. 5A-5C, FIGS. 6A-6C, FIGS. 7A-7D and FIGS. 8A-8B are used to create an augured ground improvement element with expanded shaft diameters. Referring to FIG. 4, in one embodiment the apparatus is comprised of an upper section (402), a lower section (403) and an intermediate augur conveyance restriction element (404). Referring now to FIGS. 5A-5C, FIGS. 6A-6C, FIGS. 7A-7D, and FIGS. 8A-8B, the augur conveyance restriction element is comprised of a horizontally oriented flange (504) mounted on the lower portion of the upper section (402) and a corresponding horizontally oriented flange (604) mounted on the upper portion of the lower section (403). Construction of the ground improvement elements commence with the augur conveyance restrictor in the "open" position with both flanges (504, 604) in alignment. The augur (401) is typically advanced in the clockwise direction when viewed from the top of the augur. Flange alignment is facilitated by heels (not shown) placed at the ends of the flanges to prevent further rotation relative to each other when turning in the clockwise direction. As the augur (401) advances into the subsurface material, the lower portion of the augur (402) cuts into the material and conveys the cuttings upward on its augur flights. When the cuttings reach the open augur conveyance restrictor element, the cuttings advance through the semi-circular opening that is facilitated by the top-view alignment of the flanges (504, 604).

When the augur has achieved its design depth, backfill material is placed into the augur stem (408). In one embodiment, backfill may consist of concrete. In another embodiment, backfill may consist of sand-cement grout. In yet another embodiment, backfill may consist of crushed stone or gravel. In still yet another embodiment, backfill may consist of sand. In another embodiment, backfill may consist of a manmade or semi manmade flowable material. The backfill material is allowed flow out of the tip of the augur (409) when the augur is raised.

In one embodiment, the augur is raised a distance of approximately 2 feet to 6 feet above the full penetration depth while backfill is allowed to flow through the augur stem (408). In one embodiment, the auger is then advanced downward into the backfilled materials until the backfill material forms the cuttings on the augur flights below the augur conveyance restrictor element (404).

In one embodiment, the augur is once again raised to a distance of about 4 to 6 feet above the bottom of the element.

In one embodiment, the direction of the augur is then reversed so that the augur rotates in the counter-clockwise direction when viewed from the top. Because the upper portion (402) of the augur (401) may now swivel relative to the lower section (403), when the augur direction is reversed the upper section (402) rotates relative to the lower portion (403) until the upper flange (504) is oriented opposite the lower flange (604) when viewed from the top. Relative augur rotation is halted by a second set of heels (not shown) placed along the augur flanges (504, 604). As shown in FIGS. 7C and 7D and FIG. 8B, the "closed" alignment of the augur conveyance restrictor element (404) provides for a full circular restriction that inhibits the upward conveyance of cuttings.

In one embodiment, as the augur is rotated in the counter-clockwise direction, downward force, referred to as "crowd", is applied to the augur and the augur is pushed downward into the subsurface materials. The combination of downward movement and counter-clockwise "reverse" rotation forces the backfill cuttings that are on the augur flights below the augur conveyance restrictor element (404) to move down and outward relative to the augur. In this manner, an element of a larger diameter may be created using the apparatus of this invention. The purpose of the augur conveyance restrictor element is to allow reverse rotation while simultaneously preventing the downward movement of soil cuttings past the restrictor element (404) and thus inhibiting the ability of the soil cuttings to contaminate the materials placed in the expanded shaft.

Figure 9:
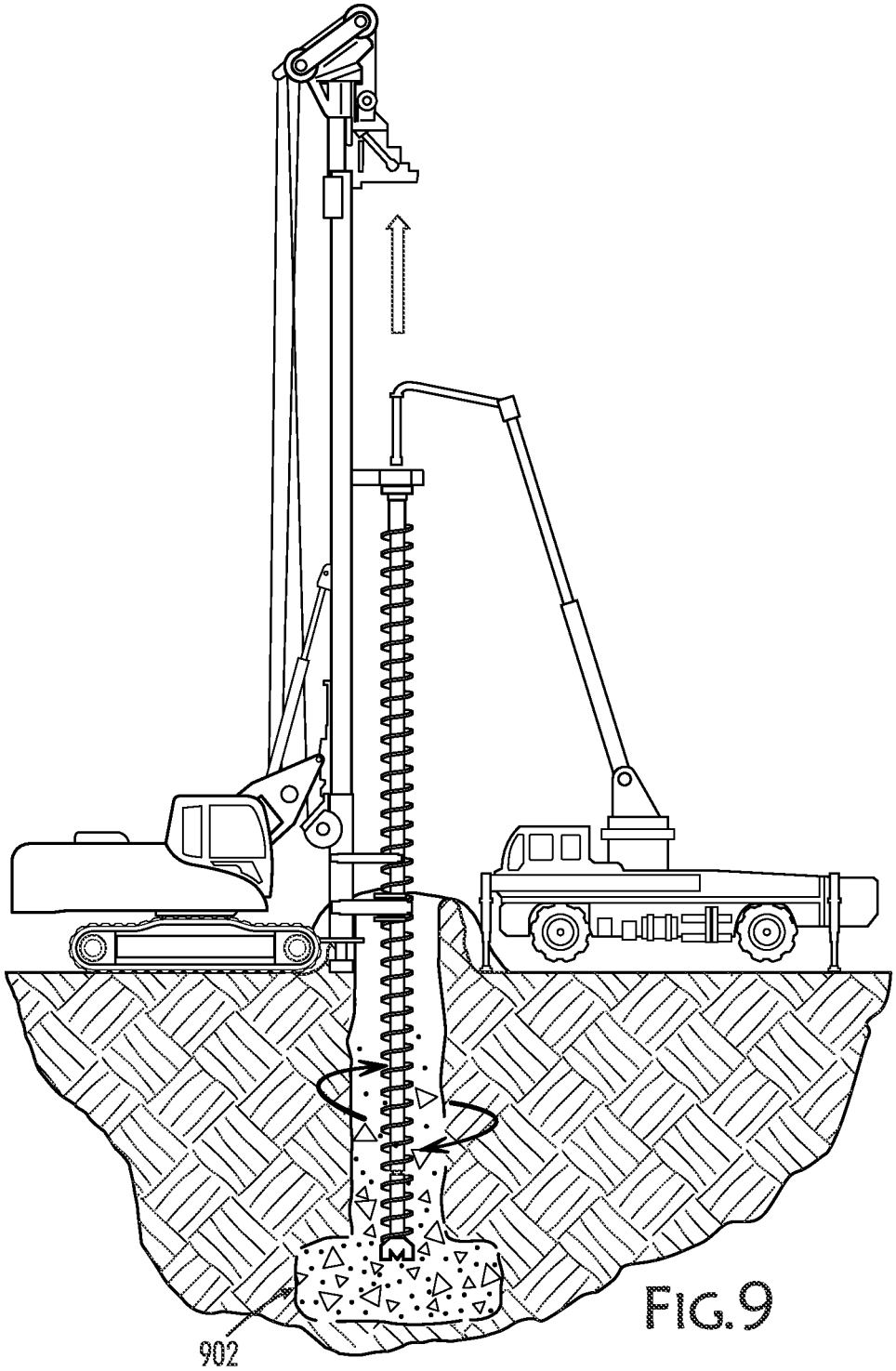
FIG. 9 shows a schematic of one embodiment of the invention whereby the construction sequence is comprised of an expanded bottom element; and, FIG. 10 shows a schematic of one embodiment of the invention whereby the construction sequence is comprised of an expanded shaft element and whereby the expansion is not located at the bottom of the element.

FIG. 9 shows one embodiment of the invention whereby the expanded shaft (902) is located at the bottom of the element.

Figure 10:
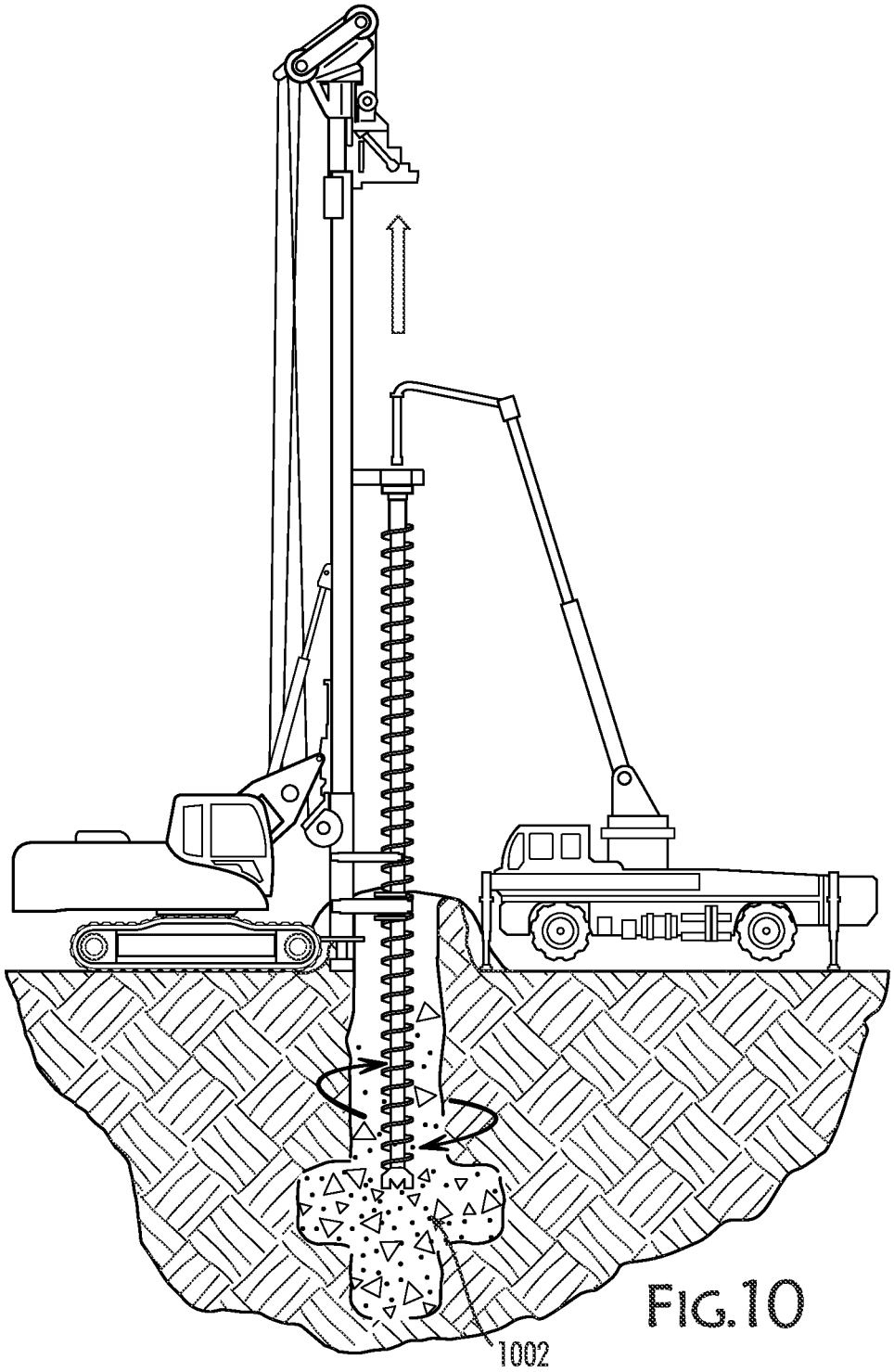

FIG. 10 shows another embodiment of the invention whereby the expanded shaft (1002) is located at a distance above the bottom of the constructed ground improvement element. In yet another embodiment, multiple expanded sections are created within the constructed element. The expanded bulb is advantageous because it provides for a higher geotechnical load capacity in comparison to elements installed with an unexpanded section. In one embodiment, once the expanded bulb is created, the auger rotation continues in the counter-clockwise direction as the auger (401) is extracted from the cavity to form a load-support element.

The foregoing detailed description of embodiments refers to the accompanying drawings, which illustrate specific embodiments of the invention. Other embodiments having different structures and operations do not depart from the scope of the present invention. The term "the invention" or the like is used with reference to certain specific examples of the many alternative aspects or embodiments of the applicant's invention set forth in this specification, and neither its use nor its absence is intended to limit the scope of the applicants' invention or the scope of the claims. This specification is divided into sections for the convenience of the reader only. Headings should not be construed as limiting of the scope of the invention. The definitions are intended as a part of the description of the invention. It will be understood that various details of the present invention may be changed without departing from the scope of the present invention.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

The term "plurality" means "two or more".

As used herein, the singular form "a", "an" and "the" include plural references unless the context clearly dictates otherwise. For example, the term "a compound" or "at least one compound" may include a plurality of compounds, including mixtures thereof.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

As used herein the term "method" refers to manners, means, techniques and procedures for accomplishing a given task including, but not limited to, those manners, means, techniques and procedures either known to, or readily developed from known manners, means, techniques and procedures by practitioners of the chemical, pharmacological, biological, biochemical and medical arts.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

We claim:

1. An apparatus for building expanded shaft augured foundation elements, comprising:

a dual-section augur having a lower section and an upper section, wherein the lower section and the upper section are configured to rotate relative to each other; and, an augur conveyance restriction element disposed between the lower section and the upper section.

2. The apparatus according to claim 1, wherein the upper section rotates independently from the lower section.

3. The apparatus according to claim 1, wherein the upper section terminates in a flat, horizontal flange at a lower end of the upper section.

4. The apparatus according to claim 3, wherein the flange is a half-circle in profile when viewed from the bottom of the flange.

5. The apparatus according to claim 3, wherein the diameter of the flange is the same or less than the diameter of at least one flight of the augur.

6. The apparatus according to claim 1, wherein the lower section terminates in a flat, horizontal flange at an upper end of the lower section.

7. The apparatus according to claim 6, wherein the flange is a half-circle in profile when viewed from the bottom of the flange.

8. The apparatus according to claim 6, wherein the diameter of the flange is the same or less than the diameter of at least one flight of the augur.

9. The apparatus according to claim 1, wherein a lower portion of the upper section and an upper portion of the lower section form the augur conveyance restrictor element.

10. The apparatus according to claim 9, wherein the augur conveyance restrictor element is configured in an open configuration when the upper section is aligned coincident with the lower section.

11. The apparatus according to claim 9, wherein the augur conveyance restrictor element is configured in a closed configuration when the upper section is not aligned coincident with the lower section.

12. The apparatus according to claim 1, further comprising a hollow augur stem through which backfill material flows during operation.

13. The apparatus according to claim 1, further comprising a tip at a bottom end of the dual-section drilling augur through which backfill material flows during operation.

14. A method for building expanded shaft augured foundation elements, comprising:

aligning a lower section and an upper section of a dual-section drilling augur to achieve an open configuration to allow for augur spoil conveyance.;

advancing the dual-section drilling augur in to a subsurface ground material, wherein as the dual-section drilling augur cuts into the subsurface material, cuttings are conveyed upwards on flights of the dual-section drilling augur, enabled by the open configuration;

placing backfill material into the dual-section drilling augur when design depth has been achieved;

raising the dual-section drilling augur to allow the flow of the backfill material out of the dual-section drilling augur at the design depth;

re-advancing the dual-section drilling augur downwardly into the backfill material until the backfill material forms cuttings on augur flights of the lower section;

reversing rotation direction of the dual-section drilling augur causing the upper section to swivel relative to the lower section and placing the dual-section drilling augur into a closed configuration which prohibits the upward conveyance of cuttings; and, creating an expanded shaft, augured foundation element through a combination of downwardly movement and the reverse rotation of the dual-section drilling augur forcing the backfill material cuttings that are on the augur flights of the lower section to move down and outward relative to the dual-section drilling augur.

15. The method according to claim 14, wherein reversing rotation is rotating the dual-section drilling augur in a counter-clockwise direction.

16. The method according to claim 14, wherein backfill material is placed into a hollow augur stem of the dual-section drilling augur.

17. The method according to claim 14, wherein the backfill material flows out of the placing backfill material into the dual-section drilling augur from a tip at a bottom end of the dual-section drilling augur.

18. The method according to claim 14, wherein the expanded shaft is located at at least one of the bottom of the augured foundation element and at a distance above the bottom of the augured foundation element.

19. The method according to claim 14, further comprising continuing reverse rotation upwardly to extract the dual-section drilling augur to complete forming the augured foundation element.

* * * * *